United States Patent [19]

Gardiner et al.

[11] 4,069,162

[45] Jan. 17, 1978

[54] HAZE FREE OIL ADDITIVE COMPOSITIONS CONTAINING POLYMERIC VISCOSITY INDEX IMPROVER AND PROCESS FOR PRODUCING SAID COMPOSITIONS

[75] Inventors: John Brooke Gardiner, Mountainside; Max W. Hill, Westfield; Jack Ryer, East Brunswick, all of N.J.

[73] Assignee: Exxon Research & Engineering Co., Linden, N.J.

[21] Appl. No.: 628,342

[22] Filed: Nov. 3, 1975

[51] Int. Cl.[2] ..... C10M 1/48; C10M 3/42; C10M 5/24; C10M 7/46

[52] U.S. Cl. ..... 252/32.7 E; 252/32.5; 252/33.4; 252/40.5; 252/42; 252/59

[58] Field of Search ..... 252/59, 48.2, 17, 33.4, 252/32.5, 32.7 E, 33.6, 35, 39, 40.5, 49.8, 56 R, 46.6, 42

[56] References Cited

U.S. PATENT DOCUMENTS

| | | | |
|---|---|---|---|
| 3,290,244 | 12/1966 | Polishuk et al. | 252/59 |
| 3,412,027 | 11/1968 | Morway et al. | 252/59 |
| 3,526,596 | 9/1970 | Kress et al. | 252/49.8 |
| 3,538,138 | 11/1970 | Dunbar | 252/48.2 |
| 3,897,353 | 7/1975 | Morduchowitz et al. | 252/59 |
| 3,941,834 | 3/1976 | Lee | 252/48.2 |

*Primary Examiner*—George J. Crasanakis
*Assistant Examiner*—Irving Vaughn
*Attorney, Agent, or Firm*—Roland A. Dexter; Frank T. Johmann

[57] ABSTRACT

Oil compositions comprising a lubricating oil and an oil-soluble hydrocarbon polymeric viscosity index improver such as ethylene-propylene copolymers are substantially haze-free when said composition contains an anti-hazing amount of an oil-soluble strong acid containing a hydrogen dissociating moiety which has a pK of less than about 2.5, e.g. a $C_{25}$ to $C_{70}$ hydrocarbyl substituted sulfonic acid. The invention also relates to the process for preparing said compositions.

7 Claims, No Drawings

HAZE FREE OIL ADDITIVE COMPOSITIONS CONTAINING POLYMERIC VISCOSITY INDEX IMPROVER AND PROCESS FOR PRODUCING SAID COMPOSITIONS

BACKGROUND OF THE INVENTION

1. Field of the Invention

This invention relates to haze-free lubricating oil compositions having an improved viscosity index resulting from the presence of a hydrocarbon polymeric viscosity index improver as well as to the haze-free additive concentrates by means of which said lubricating oil compositions were formulated. In particular, this invention is directed to haze-free lubricating oil compositions and additive packages used in formulating them containing ethylene-propylene copolymer viscosity index improvers and a haze preventing amount of an oil-soluble strong acid.

2. Description of the Prior Art

An important property of a lubricating composition is the rate at which its viscosity changes as a function of temperature. The relationship between the viscosity and temperature is commonly expressed as the viscosity index (V.I). Lubricant compositions which change little in viscosity with variations in temperature have a greater viscosity index than do compositions whose viscosity is materially affected by changes in temperature. One of the major requirements of the lubricating oils is a satisfactory viscosity-temperature characteristic so that the oils will not lose their fluidity but will show an equally good performance within a relatively wide temperature range to which they may be exposed in service.

In addition to refining natural petroleum oils to improve their viscosity index characteristics, it has been common practice to introduce long chained compounds of the nature of linear polymers in order to raise the viscosity index of lubricant compositions. Among the V.I. improvers that have been described in the prior art are included: polyisobutylenes as taught in U.S. Pat. Nos. 2,084,501 and 2,779,753; polyalkylmethacrylates as described in U.S. Pat. No. 3,607,749; copolymers of alkylmethacrylates and styrene as shown in U.S. Pat. No. 3,775,329; hydrogenated butadienestyrene copolymers as shown in U.S. Pat. No. 2,798,853; and copolymers of butadiene, styrene and isoprene as shown in U.S. Pat. No. 3,795,615.

It has now become well known to utilize ethylenealpha olefin copolymers as viscosity index improvers with high thickening potency, relatively low haze and superior shear stability as seen from the following:

Lubricants containing copolymers of ethylene and propylene having from 60 to 80 mole % of ethylene and viscosity-average molecular weight in the range of 10,000 to 200,000 have been described in U.S. Pat. No. 3,551,336;

U.S. Pat. No. 3,522,180 describes a lubricating oil composition containing a viscosity index improver comprising an ethylene-propylene copolymer having an amorphous structure with a number average molecular weight ($\overline{M}_n$) of between 10,000 and 40,000 and a propylene content of 20 to 70 mole % and a $M_w/M_n$ of less than about 5 which is said to provide a substantially shear stable blend with improved viscosity index;

U.S. Pat. No. 3,598,738 describes a mineral oil composition containing a viscosity index improver of a class of oil-soluble substantially linear ethylene hydrocarbon copolymers containing 25 to 55 wt. % polymerized ethylene units and from about 75 to 45% of a comonomer selected from the group consisting of unsaturated straight chain monoolefins of 3 to 12 carbon atoms, Ω-phenyl-1-alkenes of 9 to 10 carbon atoms, norbornenes and unsaturated non-conjugated diolefins of 5 to 8 carbon atoms which results in systems of outstanding shear stability, and British Pat. No. 1,205,243 describes the preparation of ethylene-propylene copolymers, obtained by direct synthesis, having a measurable degree of side chain branching and ($\overline{M}_n$) of between 40,000 and 136,000.

The prior art also discusses the mechanical agitation, churning or other mechanical disruptions of polymeric materials in U.S. Pat. Nos. 2,727,693; 2,776,274; 2,858,299; and 3,503,948. The degradation of the molecular weight of ethylene-propylene copolymers has become useful in the preparation in order to make various grades of polymers having different molecular weights and different thickening efficiencies in the lubricating oil. Such a degraded olefin polymer has been found to be useful when the precursor higher molecular weight ethylene-propylene copolymer has an ethylene content in the range of 40 to 85%, a degree of crystallinity of from about 1 to 25 wt. % and a molecular weight ($\overline{M}_n$) of from 20,000 to 200,000 as taught by U.K. Pat. No. 1,397,994.

It is often found during the preparation, processing and storage of these various oil soluble hydrocarbon polymers that a haze develops in their oil concentrates. The source of this haze does not appear to be the same as that haze resulting from incompatibility of the several additives in a lubricating oil additive concentrate (see U.S. Pat. No. 3,897,353 wherein haze resulting from component incompatibility is overcome in a lubricating oil additive concentrate by blending an amorphous ethylene-propylene copolymer with an n-alkyl methacrylate containing polymer having a number average molecular weight between about 30,000 and about 120,000).

SUMMARY OF THE INVENTION

It has been discovered that a wide variety of unwanted catalysts, metal weak acid salts which result from the by-products of the polymerization, finishing process or other steps in the manufacture of ethylene-containing copolymers oil concentrates can cause haze in and create filtration problems of lubricating oil compositions prepared from said ethylene copolymers. These haze and/or filtration problems can be overcome by treating the hydrocarbon polymer or its oil concentrate which comprises a hydrocarbon solvent and from 0.1 to 50, preferably 5 to 30 wt. % based upon said solution, of a soluble hydrocarbon polymeric material having viscosity index improving characteristics with an oil soluble strong acid, said acid containing a hydrogen dissociating moiety which has a pK of from about 0.001 to about 2.5, preferably ranging from about 0.1 to about 2.0. This invention has particular utility when the hazing substance is a metal salt of a weak acid, said weak acid having a pK of more than about 3.8, preferably a pK of 4.0 to about 8 and said hazing substance has a particle size of from about 0.01 microns to about 15 microns. It is preferred to treat the hydrocarbon solvent containing the hazing substance which is derived from the dissociable metal containing material, i.e. the weak acid, by introducing the oil-soluble strong acid within the range of from about 0.1 to about 2.5 equivalents, preferably about 1 equivalent of strong acid per equivalent of metal extant in said hazing substance. These treatment ranges can be adjusted to reflect the relative oil solubility of the hazing substance, e.g., a semisoluble hazing substance would be treated at a level less than an equivalent basis. Useful strong acids which eliminate the hazing property of the hazing substance are represented by oil-soluble derivatives of maleic acid, malonic acid, phosphoric acid, thiophosphoric acids, phosphonic acid, thiophosphonic acids, phosphinic acid, thiophosphinic acids, sulfonic acid, sulfuric acid, and alphasubstituted halo- or nitro- or nitrilo-carboxylic acids.

In a preferred method according to the invention, haze is prevented in an oil additive composition comprising a hydrocarbon solvent, from 0.1 to 50 wt. %, based on said solvent of an ethylene-propylene copolymer viscosity index improver having a molecular weight ($\overline{M}_n$) of 700 to 500,000 and a hazing substance containing calcium stearate of particle diameter ranging from about 0.01 microns to about 15 microns by the step of treating said composition with a polymethylene substituted benzene sulfonic acid, said polymethylene substituent having a molecular weight of about 500, in an amount of from about 0.01 wt. % to 1.0 wt. % at a temperature within the range of about room temperature to about 250° C. and for a period from about 0.1 hour to about 20 hours, e.g. for ½ hour at 120° C. This method results in an additive oil composition which has no visually perceptive haze and a filterable residue through a mesh filter at 20° C. of less than 0.001 volume percent based on the total volume of said composition. The anti-hazing agent of the novel oil compositions of the invention appears to convert at least part of the oil-insoluble hazing substance to an oil-soluble material. This conversion can be represented by the equation:

Oil-insoluble metal hazing substance +
Oil-soluble strong acid ⇄
Oil-soluble weak acid or volatile product +
Oil-soluble strong acid metal salt It appears that utilizing an oil-soluble acid with a pK of less than about 2.5 provokes removal of the metal from the hazing substance thereby eliminating the visual haze property of said substance and converting the metal into an oil-soluble derivative and/or ionic complex of said strong acid which seems both time and ambient temperature stable since haze does not reappear in compositions subjected to ambient temperature cycling over several months.

DESCRIPTION OF PREFERRED EMBODIMENT

1. Viscosity Index Improving Polymers

As earlier indicated, oil soluble hydrocarbon polymeric viscosity index improver oil compositions are contemplated to be processed in accordance with this invention whereby said compositions are substantially haze free. These V.I. improving polymers are hydrocarbon polymers having a number average molecular weight ($\overline{M}_n$) of from about 700 to about 500,000, preferably 10,000 to 200,000 and optimally from about 20,000 to 100,000. In general, hydrocarbon polymers having a narrow range of molecular weight, as determined by the ratio of weight average molecular weight ($\overline{M}_w$) to number average molecular weight ($\overline{M}_n$) are preferred. Polymers having a $\overline{M}_w/\overline{M}_n$ of less than 10, preferably less than 7, and most preferably 4 or less are most desirable. As used herein ($\overline{M}_n$) and ($\overline{M}_w$) are measured by the well known techniques of vapor pressure (VPO) and membrane osmometry and gel permeation chromotography, respectively. These hydrocarbon polymers are prepared from ethylenically unsaturated hydrocarbons including cyclic, alicyclic and acyclic containing from 2 to 30 carbons.

Most commonly used are oil-soluble polymers of isobutylene. Such polyisobutylenes are readily obtained in a known manner as by following the procedure of U.S. Pat. No. 2,084,501 wherein the isoolefin, e.g. isobutylene, is polymerized in the presence of a suitable Friedel-Crafts catalyst, e.g. boron fluoride, aluminum chloride, etc., at temperatures substantially below 0° C. such as at −40° C. Such polyisobutylenes can also be polymerized with a higher straight chained alpha olefin of 6 to 20 carbon atoms as taught in U.S. Pat. No. 2,534,095 where said copolymer contains from about 75 to about 99% by volume of isobutylene and about 1 to about 25% by volume of a higher normal alpha olefin of 6 to 20 carbon atoms.

Other polymeric viscosity index modifier systems used in accordance with this invention are: copolymers of ethylene and $C_3$–$C_{18}$ monoolefins as described in Canadian Pat. No. 934,743; copolymers of ethylene, $C_3$–$C_{12}$ mono-olefins and $C_5$–$C_8$ diolefins as described in U.S. Pat. No. 3,598,738; mechanically degraded copolymers of ethylene, propylene and if desired a small amount, e.g. 0.5 to 12 wt. % of other $C_4$ to $C_{12}$ hydrocarbon mono- or diolefins as taught in U.S. Pat. No. 3,769,216 and U.K. Pat. No. 1,397,994; a polymer of conjugated diolefin of from 4 to 5 carbon atoms including butadiene, isoprene, 1,3-pentadiene and mixtures thereof as described in U.S. Pat. No. 3,312,621; random copolymers of butadiene and styrene which may be hydrogenated as described in U.S. Pat. Nos. 2,798,853 and 3,554,911; and hydrogenated block copolymers of butadiene and styrene as described in U.S. Pat. No. 3,772,169; and random or block including hydrogenated (partially or fully) copolymers of butadiene and isoprene with up to 25 mol percent of a $C_8$–$C_{20}$ monovinyl aromatic compound, e.g. styrene as described in U.S. Pat. No. 3,795,615 (see also Belgium Pat. No. 759,713).

Particularly preferred for haze-removal treatment according to this invention are ethylene copolymers of from about 2 to about 98, preferably 30 to 80, optimally 38 to 70 wt. % of ethylene and one or more $C_3$ to $C_{30}$ alpha olefins, preferably propylene, which have a degree of crystallinity of less than 25 wt. % as determined by X-ray and differential scanning calorimetry and have a number average molecular weight ($\overline{M}_n$) in the range of about 700 to about 500,000 as determined by vapor phase osmometry (VPO) or membrane osmometry. Terpolymers containing ethylene, e.g. ethylene-propylene-ethylidene norbornene are also contemplated to be used herein. The amount of the third monomer (a $C_5$ to $C_{15}$ non-conjugated diolefin) ranges from about 0.5 to 20 mole percent, preferably about 1 to about 7 mole percent, based on the total amount of ethylene and alpha olefin present. Representative of third monomers are one or more of the following: cyclopentadiene, 2-methylene-5-norbornene, a non-conjugated hexadiene, or any other alicyclic or aliphatic non-conjugated diolefin having from 6 to 15 carbon atoms per molecule such as 2-methyl norbornadiene, 2,4-dimethyl-2-octadiene, 3-(2-methyl-1-propene) cyclopentene, etc. These ethylene copolymers and terpolymers may be readily prepared using soluble Ziegler-Natta catalyst compositions which are well known in the art. For recent reviews of the literature and patent art see: "Polyolefin Elastomers Based on Ethylene and Propylene", by F. P. Baldwin and G. VerStrate in Rubber Chem. & Tech. Vol. 45, No. 3, 709–881 (1972) and "Polymer Chemistry of Synthetic Elastomers", edited by Kennedy and Tornqvist, Interscience, N.Y. 1969.

Suitable copolymers may be prepared in either batch or continuous reactor systems. In common with all ZieglerNatta polymerizations, monomers, solvents and catalyst components are dried and freed from moisture, oxygen or other constituents which are known to be harmful to the activity of the catalyst system. The feed tanks, lines and reactors may be protected by blanketing with an inert dry gas such as purified nitrogen. Chain propagation retarders or stoppers, such as hydrogen and anhydrous hydrogen chloride, may be fed continuously or intermittently to the reactor for the purpose of controlling the molecular weight within the desired limits and the degree of crystallinity known to be optimum for the end product.

Examples of the above-noted alpha monoolefins include propylene, 1-butene, 1-pentene, 1-hexene, 1-heptene, 1-decene, 1-dodecene, etc.

Representative non-limiting examples of non-conjugated diolefins include:

A. Straight chain a cyclic dienes such as: 1,4-hexadiene; 1,5-heptadiene, 1,6-octadiene.

B. Branched chain acyclic dienes such as: 5-methyl-1,4-hexadiene; 3,7-dimethyl 1,6-octadiene; 3,7-dimethyl-1,7-octadiene; and the mixed isomers of dihydromyrcene and dihydroocimene.

C. Single ring alicyclic dienes such as: 1,4-cyclohexadiene; 1,5-cyclo-octadiene; 1,5-cyclododecadiene; 4-vinylcyclohexene; 1-allyl-4-isopropylidene cyclohexane; 3-allylcyclopentene; 4-allylcyclohexene and 1-isopropenyl-4(4-butenyl) cyclohexane.

D. Multi-single ring alicyclic dienes such as: 4,4'-dicyclopentenyl and 4,4'-dicyclohexenyl dienes.

E. Multi-ring alicyclic fused and bridged ring dienes such as tetrahydroindene; methyl tetrahydroindene; dicyclopentadiene; bicyclo (2,2,1) hepta-2,5-diene; alkenyl, alkylidene, cycloalkenyl and cycloalkylidene norbornenes such as: 5-methylene-2-norbornene; 5-ethylidene-2-norbornene; 5-methylene-6-methyl-2-norbornene; 5-methylene-6,6-dimethyl-2-norbornene; 5-propenyl-2-norbornene; 5-(3-cyclopentenyl)- 2-norbornene and 5-cyclohexylidene-2-norbornene.

In general the preparation of copolymers suitable for the practice of this invention by means of Ziegler-Natta catalysts is known in the prior art, for example, see U.S. Pat. Nos. 2,933,480; 3,000,866; and 3,093,621. The copolymers, which are primarily produced for use in elastomeric compositions, are characterized by the absence of chain or backbone unsaturation, and when made from non-conjugated dienes contain sites of unsaturation in groups which are pendant to or are in cyclic structures outside the main polymer chain. These unsaturated structures render the polymers particularly resistant to breakdown by atmospheric oxidation or ozone. Ethylene-propylene-non-conjugated diolefin copolymers are known articles of commerce. In fact, various examples of such commercially available copolymers are VISTALON®, elastomeric copolymers of ethylene and propylene alone or with 5-ethylidene, 2-norbornene, marketed by EXXON Chemical Co., New York, N.Y., and Nordel®, a copolymer of ethylene, propylene and 1,4-hexadiene, marketed by E. I. duPont de Nemours & Co., Wilmington, Delaware.

In general, the catalyst compositions used to prepare these copolymers comprise a principal catalyst consisting of a transition metal compound from Groups IVb, Vb, and VIb of the Periodic Table of the Elements, particularly compounds of titanium and vanadium, and organometallic reducing compounds from Groups II*a*, II*b* and III*a*, particularly organoaluminum compounds which are designated as cocatalysts. Preferred principal catalysts of vanadium have the general formula $VO_zX_t$ wherein $z$ has a value of 0 or 1 and $t$ has a value of 2 to 4. X is independently selected from the group consisting of halogens having an atomic number equal to or greater than 17, acetylacetonates, haloacetylacetonates, alkoxides and haloalkoxides. Non-limiting examples are: $VOCl_3$; $VO(AcAc)_2$; $VOCl_2(OBu)$; $V(AcAc)_3$; and $VOCl_2(AcAc)$ were Bu is n-butyl or isobutyl and (AcAc) is an acetylacetonate.

Preferred cocatalysts have the general formula $AlR'_mX'_n$ wherein R' is a monvalent hydrocarbon radical selected from the group consisting of $C_1$ to $C_{12}$ alkyl, alkylaryl, arylalkyl and cycloalkyl radicals, X' is a halogen having an atomic number equal to or greater than 17, $m$ is a number from 1 to 3 and the sum of $m$ and $n$ is equal to 3. Non-limiting examples of useful cocatalysts are: $Al(Et)_3$; $Al(IsoBu)_3$; $Et_2AlCl$; $EtAlCl_2$ and $Et_3Al_2Cl_3$.

Syntheses of the copolymers, which may be conducted in batch, staged or continuous reactors, are preferably run in the presence of a purified solvent such as hexane which has been percolated through LINDE 3A catalyst and in the absence of moisture, air or oxygen and catalyst poisons. An atmosphere of oxygen-free nitrogen is preferably maintained above the reactants. Monomers, principal catalyst and cocatalyst are fed to the reactor supplied with means for withdrawing the heat of reaction and maintained under controlled agitation for a time, temperature and pressure sufficient to complete the reaction.

Suitable times of reaction will generally be in the range from 1 to 300 minutes, temperatures will usually be in the range of −40° C. to 100° C. preferably 10° C. to 80° C., most preferably 20° C. to 60° C. and pressures from atmospheric to 160 psig are generally used. Monomer feed to the reactor per 100 parts by weight of solvent may be in the range of: ethylene, 2 to 20 parts by weight, $C_3$ to $C_{18}$ $\alpha$-olefin, 4 to 20 parts by weight and non-conjugated diene 0.1 to 10 parts by weight.

Principal catalyst, $VOCl_3$ for example, prediluted with solvents is fed to the reactor so as to provide a concentration in the range of 0.1 to 5.0 millimoles per liter. Cocatalyst, for example $Et_3Al_2Cl_3$ is at the same time fed to the reactor in an amount equal to from 2.0 to 20.0 moles of cocatalyst per mole of principal catalyst.

In general, polymers having a narrow range of molecular weight may be obtained by a choice of synthesis conditions such as choice of principal catalyst and cocatalyst combination and addition of hydrogen during the synthesis. Post synthesis treatment such as extrusion at elevated temperature and under high shear through small orifices and fractional precipitation from solution may also be used to obtain narrow ranges of desired molecular weights. For a comprehensive review of the art see: "Polymer Chemistry of Synthetic Elastomers", edited by Kennedy and Tornqvist, Interscience, N.Y. 1969.

Molecular weight may be further regulated by choice of solvent, principal catalyst concentration, temperature, and the nature and amount of the cocatalyst, e.g., aluminum alkyl cocatalyst concentration.

Since the reactivity of the high alpha olefin and rate in which it is incorporated into the copolymer is less than it is for ethylene, it is desirable to feed somewhat more than the theoretical proportions of higher alpha olefin to obtain a copolymer having the desired ethylene content.

Conventional procedures, well known in the art may be used for recovery of the polymer from the reaction mixture leaving the reactor. The polymer "cement" issuing from the reactor may be quenched with a lower alcohol such as methanol or isopropanol. A chelating agent can be added to solubilize the catalyst residues, and the polymer recovered as an aqueous slurry by steam stripping. The resulting wet crumb may be purified by filtration, and then dried at a moderately elevated temperature under vacuum.

OIL-SOLUBLE HYDROCARBYL SUBSTITUTED STRONG ACID

In accordance with the practice of this invention, the hazy oil additive composition will be treated with an oil-soluble strong acid, said acid containing a hydrogen dissociating moiety which has a pK of less than about 2.5, preferably from about 0.001 to about 2.5. The term pK for the purpose of this disclosure is used herein to express the extent of the dissociation of the acid used to treat the haze causing substance which is derived from a metal-containing dispersion. Thus, pK can be defined as the negative logarithm to the base 10 of the equilibrium constant for the dissociation of the oil-soluble strong acid. For the purposes of this invention, the strong acids have a pK of up to about 2.5 and optimally ranges from about 0.1 to about 2 whereas the weak acid which is associated with the metal in order to provoke the haze has an acid moiety providing a pK of more than about 3.8, usually in the range of 4 to 8 and can be represented by stearic acid. Thus, for purposes of illustration, a typical haze producing substance has been found to be calcium stearate having a particle size of from about 0.01 microns to about 15 microns, more usually from about 3 microns to about 15 microns.

Representative classes of the strong acids which are used in accordance with this invention are the oil-soluble strong acids which are represented by maleic acid, malonic acid, phosphoric acid, thiophosphoric acids, phosphonic acid, thiophosphonic acids, phosphinic acid, thiophosphinic acids, sulfonic acid, sulfuric acid, and alphasubstituted halo- or nitro- or nitrilo-carboxylic acids wherein the oil solubilizing group or groups are hydrocarbyl and containing from about 3 to about 70, preferably from about 6 to 40, optimally 10 to 30, carbon atoms.

Particularly preferred for use in this invention for treating the hazing substance are the oil-soluble sulfonic acids which are typically alkaryl sulfonic acids. These sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to about 70 carbon atoms such as for example haloparaffins, olefins that may be obtained by dehydrogenation of paraffins, polyolefins as for example polymers from ethylene, propylene, etc. Preferred sulfonic acids are those obtained by the sulfonation of hydrocarbons prepared by the alkylation of benzene or toluene with tri-, tetraor penta-propylene fractions obtained by the polymerization of propylene. The alkaryl sulfonates contain from about 9 to about 70 or more carbon atoms, preferably from about 11 to about 20 carbon atoms per alkyl substituted aromatic moiety. Particularly preferred is a didodecylbenzene sulfonic acid having a molecular weight of about 500.

The alkylated benzene from which the sulfonic acid is prepared is obtained by known alkylation processes; benzene being generally reacted with such alkylating agents as isobutylene, isoamylene, diisobutylene, triisobutylene, etc. or olefin-obtained mixtures containing from refinery gases. Boron trifluoride is a preferred alkylating agent.

Among the $C_3$–$C_{64}$ alkylated benzenes which are preferably employed in the preparation of the sulfonic acid are p-isopropylbenzene, p-amylbenzene, isohexylbenzene, p-octylbenzene, nonylbenzene, ditertiaryoctylbenzene, waxy alkylated benzenes, benzenes alkylated with suitable branched chain polymers of up to 64 carbons obtained from propylene, butylene, amylene or mixtures thereof or the like. Optimally, nonyl or dodecyl or either of their equivalents in a mixture of alkyls is employed in preparation of the sulfonic acid.

The oil-soluble phosphorous-containing acids can be represented by the following four general formulae:

| | |
|---|---|
| (1) $RZPOZ_2H$ | phosphoric or thiophosphoric acids; |
| (2) $(RZ)_2PZ_2H$ | |
| (3) $(R)_2PZ_2H$ | phosphinic or thiophosphinic acids; and, |
| (4) $R\ POZ_2H$ | phosphonic or thiophosphonic acid |

wherein R is one or two (same or different) $C_3$–$C_{70}$ hydrocarbyl radicals such as alkyl, aryl, alkaryl, aralkyl, and alicyclic radicals to provide the required oil solubility, O is oxygen and Z is oxygen or sulfur. The acids are usually prepared by reacting $P_2O_5$or $P_2S_5$ with the desired alcohol or thiol to obtain the substituted phosphoric acids. The desired hydroxy or thiol compound should contain hydrocarbyl groups of from about 3 to about 70 carbon atoms with at least 5 carbon atoms average to provide oil solubility to the product. Examples of suitable compounds are hexyl alcohol, 2-ethylhexyl alcohol, nonyl alcohol, dodecyl alcohol, stearyl alcohol, amylphenol, octylphenol, nonylphenol, methylcyclohexanol, alkylated naphthol, etc., and their corresponding thio analogues; and mixtures of alcohols and/or phenols such as isobutyl alcohol and nonyl alcohol; orthocresol and nonylphenol; etc. and mixtures of their corresponding thio analogues.

In the preparation of the hydrocarbyl substituted thiophosphoric acids, any conventional method can be used, such as for example the preparation described in U.S. Pat. Nos. 2,552,570; 2,579,038 and 2,689,220. By way of illustration, a dialkaryl substituted dithiophosphoric acid is prepared by the reaction of about 2 moles of $P_2S_5$ with about 8 moles of a selected alkylated phenol, e.g. a mixture of $C_8$–$C_{12}$ alkyl substituted phenols, i.e. nonyl phenol, at a temperature of from 50° C. to 125° C. for about 4 hours. In the preparation of hydrocarbyl substituted thiophosphinic acids as conventionally known, a disubstituted phosphine is oxidized to give disubstituted thiophosphinic acids (see F. C. Whitmore's Organic Chemistry published by Dover Publications, New York, N.Y. (1961) page 848).

Particularly preferred for preparation of oil-soluble phosphoric, phosphonic and phosphinic acids useful in the process of the invention are mixed aliphatic alcohols obtained by the reaction of olefins with carbon monoxide and hydrogen and substituted hydrogenation of the resultant aldehydes which are commonly known as "oxo" alcohols, which oxo alcohols for optimum use according to this invention will contain an average of about 13 carbon atoms. Thus for the purposes of this invention a di-$C_{13}$ Oxo phosphoric acid which has an acid dissociating moiety with a pK of about 2.0 is preferred. The oil soluble phosphorous-containing acids are readily prepared from these alcohols by reaction with $P_2O_5$ as is well known in the art.

Another class of useful haze treating agents are oil-soluble hydrocarbyl substituted maleic acids of the general formula

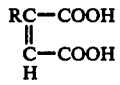

wherein R is an oil solubilizing, hydrocarbyl group, preferably containing from 12 to 70 carbons, as earlier referenced in regard to the phosphorous-containing acids. Representative of these oil soluble maleic acid derivatives are dodecylmaleic acid (1,2-dicarboxyl tetradecene-1), tetradecylmaleic acid, eicosylmaleic acid, triacontanylmaleic acid, polymers of $C_2$–$C_5$ mono-olefins having from 12 to 70 or more carbons substituted onto said maleic acid, etc.

Additional haze treating agents are oil soluble hydrocarbyl, preferably containing from 12 to 70 carbons, substituted malonic acid of the general formula

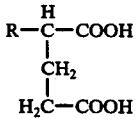

wherein R has the meaning set forth above as an oil solubilizing, hydrocarbyl group which is illustrated by the following representative compounds which include the malonic acid counterparts of the above-referenced hydrocarbyl substituted maleic acids, i.e. dodecylmalonic acid (1,3-dicarboxypentadecane), tetradecyl malonic acid, etc.

Another class of haze treating agents are oil-soluble hydrocarbyl, preferably containing from 12 to 70 carbons, substituted sulfuric acids of the general formula $RHSO_4$ wherein R has the meaning set forth above as an oil-solubilizing group which is represented by the following compounds which inlude dodecylsulfuric acid; tetradecylsulfuric acid, eicosylsulfuric acid, triacontanylsulfuric acid, etc.

A further group of strong acids which can be used in accordance with the invention to treat the haze producing materials are oil-soluble mono- and di- α-substituted hydrocarbyl carboxylic acids having the general formula:

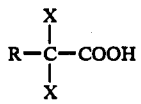

wherein R is a $C_{12}$–$C_{70}$ hydrocarbyl, oil solubilizing group as referenced above and X refers to hydrogen; a halogen such as bromine, chlorine and iodine; nitrilo or a nitro group. These materials are represented by the following: α-nitro, α,α-di-nitro, α-chloro and α,α-dichloro-substituted acids such as dodecanoic, pentadecanoic, octadecanoic, docosanoic, octacosanoic, tricontanoic, tetracontanoic, pentacontanoic, hexacontanoic, heptacontanoic, etc.

For purpose of this disclosure, an oil-soluble functionalized polymer having strong acidic groups identical to those strong acid moieties described above having a pK of less than about 2.5 is to be considered an alternative to the lower molecular weight strong acidic anti-hazing agents earlier described. An example of such a polymer type is a sulfonic acid containing ethylene, propylene, ethylidene-norbornene terpolymers (see U.S. Pat. No. 3,642,728). The functional strong acid groups can be positioned in the terminal positions or randomly along the polymer chain. They can be introduced during polymerization by functionalized monomers or by postpolymerization reactions. Care must be exercised to make sure the number of acid groups is low for a given molecular weight to provide sufficient oil solubility. The above example can be used if the sulfonation is at a low enough level to make the polymer soluble.

HAZE TREATING CONDITIONS

The oil additive composition containing the ethylene copolymer viscosity index improving material normally contains from about 0.1 to about 50 wt. % based upon the total weight of the hydrocarbon solution of an ethylene copolymer additive. It has been found that those oil additive compositions which are hazy and can be treated according to the invention contain a hazing agent derived from a dissociable metal containing material such as a metal salt of a weak organic acid. A weak organic acid has an acid moiety having a pK of more than about 3.8 usually a pK of 4 to 8. The hazing agent typically has a particle size of from about 0.01 microns to about 15 microns and is present in a concentration of less than 1 wt. %, more usually less than 0.1 wt. %.

These metals which are found to contribute to haze include the alkaline earth metals, zinc, sodium, potassium, aluminum, vanadium, chromium, iron, manganese, cobalt, nickel, cadmium, lead, bismuth and antimony. Such metals which develop the haze can come from a variety of sources during the manufacture of the ethylene copolymer including the catalyst, impurities developed during mechanical processing of the ethylene copolymer and from dispersants used to maintain the polymer in dispersion or suspension while stored during subsequent processing or awaiting shipping. It is generally possible to filter out those haze contributing particles which have a particle size greater than about 15 microns. At lesser sizes, it has been found that the haze producing impurity is difficultly if not impossible to filter so that it is optimally treated according to this invention.

It has been found useful to carry out the process by first treating the ethylene copolymer containing oil solution with the oil-soluble strong acid in an amount within the range of from about 0.1 to about 2.5 equivalents of strong acid per equivalent of metal and thereafter filtering out the large process debris or insoluble particulate matter. Preferably the oil-soluble strong acid is added in an amount of about 1 equivalent per equivalent of metal. A common way to exercise the process is to convert to a weight basis and to add the strong acid in an amount usually of less than about 1 wt. % based upon the total weight of the oil composition, preferably from about 0.1 to about 0.5 wt. %.

The treatment of the haze containing ethylene copolymer oil composition is carried out at a temperature of about room temperature to about 250° C., preferably from about 50 to about 160° C. and for a time period of about 0.1 hour up to about 20 hours, preferably from 0.5 to about 2 hours. There is no need to carry out the treatment under pressure. This makes it possible to conduct the process of the invention in an open vessel in the presence of air or inert gas wherein the amount of haze treating agent, i.e. the oil-soluble strong acid is added with stirring. It is useful to blend ethylene copolymer (V.I. improver) solutions containing the anti-hazing amount of oil-soluble strong acid with zinc dialkyldithiophosphate in the presence of a diluent oil for additive concentrate applications. To stabilize the zinc dialkyldithiophosphate system, e.g. 1 to 10 volume % of zinc di($C_4$–$C_5$ alkanol) dithiophosphate in diluent mineral oil, against hydrolysis, it is necessary to add 0.01 to 0.1 wt. % amine phosphate, such as di-$C_{13}$-Oxo hydrogen acid phosphate neutralized with a diamine, e.g. n-propylstearyl diamine (see U.S. Pat. No. 3,826,745).

The following examples illustrate more clearly the process of the present invention. However, these illustrations are not to be interpreted as specific limitations of this invention.

EXAMPLE 1

100 grams of an oil concentrate of an ethylene-propylene copolymer consisting of about 8% by weight of said copolymer having an ethylene content of 46 wt. %, a $\overline{M}_n$ of 53,000, a $\overline{M}_w$ of 154,000, an $\overline{M}_w/\overline{M}_n$ of 2.9 dissolved in S-100 Neutral Mineral Oil was heated to about 120° C. whereupon 0.1 grams of a commercial alkaryl sulfonic acid known as SA-119 sold by Esso S. A. France of Port Jerome, France was added with stirring. The SA-119 is a 90% active oil concentrate of primarily di-dodecylbenzene sulfonic acid having a $\overline{M}_n$ of 500. After ten minutes of stirring, the sample was cooled to room temperature. The original sample of the oil concentrate of ethylene-propylene copolymer was very hazy to the eye whereas the concentrate treated with the SA-119 was clear to the eye. The original and treated samples were placed in a nephelometer to measure the change in haze and readings from the instrument (named Nepho-colorimeter Model 9 sold by the Coleman Instrument Corporation of Maywood, Illinois) gave a reading of 37 on the untreated sample whereas the treated sample has a reading of about 9. The SA-119 treated sample of this example has remained visually clear when stored at room temperature for over 6 weeks.

EXAMPLE 2

2000 grams of the oil concentrate of Example 1 was heated to 100° C. on a hot plate and 2.20 grams of SA-119 was added with stirring. After about 2 hours, the sample was cooled to room temperature and found to be essentially free of haze when visually evaluated. At lower levels of acid the haze did not completely disappear, e.g. at 0.2 grams.

EXAMPLE 3

2000 grams of the oil concentrate of Example 1 was heated to 100° C. on a hot plate after which 2 grams of di-$C_{13}$ Oxo-hydrogen acid phosphate was added to the oil concentrate and stirred for about 2 hours. After cooling to room temperature, the oil concentrate was found to be visually haze-free. At lower levels of acid, the haze did not completely disappear. The dialkyl hydrogen acid phosphate is commercially available from E. I. duPont de Nemours & Co. of Wilmington, Delaware. In each of the oil concentrates treated in Examples 1, 2 and 3 the hazing agent appeared to be about 0.8 wt. % calcium stearate which was found to have an average particle diameter range of from about 3 to about 30 microns.

EXAMPLE 4

50 grams of an oil concentrate of an ethylenepropylene copolymer having an active content of about 8% of a polymer having 67 wt. % ethylene content, a $\overline{M}_w$ of 120,000, a $\overline{M}_n$ of 41,000 and a $\overline{M}_w/\overline{M}_n$ of 3 was treated with 0.05 grams of SA-119 by heating said oil concentrate to 100° C. on a hot plate and adding the SA-119 and stirring for about 20 minutes. When the oil concentrate is cooled to room temperature there is some apparent decrease in visual haze although some haze remains which is believed due to the ethylene copolymer. The original (untreated) oil concentrate of the high ethylene content, ethylene-propylene copolymer of this example was believed to contain about 0.6 wt. % calcium stearate. In addition to the decrease in visual haze, the addition of the anti-hazing agent markedly improves the filterability of the oil concentrate at higher temperature so that after treating the oil concentrate it becomes more readily filterable to remove the polymer debris which conventionally is found in such oil concentrates.

In summary, the preceding examples which teach the product and process of the invention have demonstrated that haze reduction of ethylene copolymer, viscosity index improving oil compositions is readily realized when such compositions are treated according to the process of this invention. Not only is the haze reduced but these compositions remain visually improved in haze reduction for periods of time usually met in the shelf life required for such oil compositions. As noted before, the treatment of the oil compositions with the anti-hazing agent also has the further advantage of improving the filterability of the oil concentrates including those with high ethylene content, ethylene-propylene copolymers.

As earlier noted the oil additive concentrate or compositions are contemplated to be admixed with other additives such as zinc dihydrocarbyl dithiophosphate and other conventional additives may also be present, including dyes, pour point depressants, anti-wear agents, such as tricresyl phosphate as well as the above-mentioned zinc compound, antioxidants such as N-phenyl, alpha-naphthyl amine, tertoctylphenol sulfide, 4,4'-methylene bis(2,6-ditert-butylphenol), other viscosity index improvers such as polymethacrylates, alkyl fumarate-vinyl acetate copolymers and the like as well as ashless dispersants, detergents, etc.

It is to be understood that the examples present in the foregoing specification are merely illustrative of this invention and are not intended to limit it in any manner; nor is the invention to be limited by any theory regarding its operability. The scope of the invention is to be determined by the appended claims.

What is claimed is:

1. A process of decreasing haze in a composition comprising:

a major amount of hydrocarbon lubricating oil;

in the range of about 5 to 30 wt. %, based upon the total weight of said composition, of an oil-soluble viscosity index improver polymer which consists essentially of about 30 to 80 wt. % ethylene and propylene, said polymer being formed by a Ziegler-Natta polymerization, said polymer having a $\overline{M}_n$ in the range from 700 to 500,000 and a $\overline{M}_w/\overline{M}_n$ ratio of less than 10; and a haze forming amount, but less than 1 wt. %, based on the total weight of said composition, of an oil insoluble, haze forming material resulting from the manufacture of said polymer, which material is a disassociable metal salt of a weak organic acid having a pK of more than about 3.8, and wherein said metal is selected from the class consisting of alkaline earth metal, zinc, sodium, potassium, aluminum, vanadium, chromium, iron, manganese, cobalt, nickel, cadmium, lead, bismuth and antimony;

which process comprises adding to said composition about 0.1 to about 2.5 equivalents, per equivalent of metal of said haze forming material, of an oil soluble hydrocarbyl substituted strong acid containing a hydrogen disassociating moiety and having a pK of less than about 2.5, and reacting for about 0.1 to about 20 hours at room temperature to about 250° C. said strong acid with said haze forming material to thereby decrease haze by converting said haze forming material either to an oil soluble weak acid or a volatile product, while converting the metal into an oil soluble strong acid metal salt and/or ionic complex of said strong acid, wherein said strong acid is selected from the group consisting of maleic acid, malonic acid, phosphoric acid, thiophosphoric acids, phosphonic acid, thiophosphonic acids, phosphinic acid, thiophosphinic acids, sulfonic acid, sulfuric acid, and alpha-substituted halo- or nitro- or nitrilo-carboxylic acids; and wherein the oil solubilizing hydrocarbyl group or groups of said strong acid contain from about 6 to about 40 carbon atoms.

2. A process according to claim 1, wherein: said viscosity index improver has a number average molecular weight of about 10,000 to about 200,000; and said oil soluble strong acid reacts with said insoluble metal salt to form an oil soluble metal salt of said strong acid and an oil soluble weak acid.

3. A process according to claim 1, wherein said strong acid is alkaryl sulfonic acid added to said composition in an amount ranging from 0.01 to 1.0 wt. %, based on the total weight of said composition.

4. A process according to claim 2, wherein said haze forming material is a calcium salt and has a particle size ranging in diameter from about 0.01 to about 15 microns.

5. A process according to claim 4, wherein said hydrocarbyl substituted strong acid is di-dodecylbenzene sulfonic acid.

6. A process according to claim 4, wherein said hydrocarbyl substituted strong acid is di($C_{13}$Oxo) hydrogen acid phosphate.

7. A process for reducing haze in an oil additive concentrate comprising a major proportion of hydrocarbon lubricating oil; from 5 to 30 wt. %, based on the total weight of said concentrate, of an ethylenepropylene copolymer viscosity index improver, having a molecular weight ($\overline{M}_n$) in the range of 700 to 500,000 and a $\overline{M}_w/\overline{M}_n$ ratio of less than 7, said copolymer consisting essentially of about 30 to 80 wt. % ethylene and propylene and prepared by a Ziegler-Natta polymerization and particles of calcium stearate having a particle size diameter in the range of about 0.01 microns to 15 microns, which causes haze in said oil; said process comprising adding to said concentrate dialkyl substituted benzene sulfonic acid having a ($\overline{M}_n$) of about 500 in an amount of from about 0.1 to about 2.5 equivalent per equivalent of said calcium and maintaining said oil concentrate for a period of from about 0.1 hour to about 20 hours at a temperature in the range from about room temperature to about 250° C. in order to form stearic acid and the calcium salt of said sulfonic acid, whereby haze is reduced.

* * * * *